COLD-PROOF WATER-PROOF GARMENT

BACKGROUND OF THE INVENTION

This invention relates to cold-proof water-proof garment designed to be worn by the crew of ships such as fishing boats, especially when they are engaged in hazardous work in cold seas, or by people aboard a ship in distress at sea to protect the wearers if they should fall into the sea.

Work at sea in the cold is difficult, and in particular, work in the rain or stormy weather is not only dangerous, but could also cause physical problems for workers, such as colds or frostbite, as the rain and sea water fall onto the workers and penetrate their clothing. If a worker should accidentally fall overboard, the sea water will penetrate his clothing so that he becomes soaked to the skin, leading to the danger of him dying from cold while a waiting for rescue. When a ship sinks in a shipwreck, the crew are obliged to stay immersed in cold sea water while waiting for rescue, so that even if they wear life jackets, it is very likely that they will freeze to death.

The present inventor has already developed several kinds of cold-proof water-proof garment specifically designed for this purpose, but it has been found that there is still room for improvement in them.

Conventional cold-proof water-proof garment has the problem that the wearer's hands become very cold as he drifts in the sea, and could even become frostbitten if he should stay long in the sea. Also, in conventional cold-proof water-proof garment, the leg portions are formed to be large in size so as to facilitate wear, so that the air in the leg portions acts as a buoyant material which makes the wearer's legs float up to the sea surface. This leaves the wearer in a very unstable posture, and makes his body movements awkward. Consequently, the rescuer's work is made difficult and also the wearer tends to drift away because of the action of the wind or tide, hindering the rescue work.

The present invention has as its object the provision of improved cold-proof water-proof garment which is free of these problems of conventional garment.

BRIEF DESCRIPTION OF THE DRAWINGS

FIGS. 3 to 5 show a third embodiment of this invention, of which FIG. 3 is a front view of the garment with the fasteners on one of the sleeves and one of the leg portions closed, and the fasteners on the other sleeve and the other leg portion open, FIG. 4 is a rear view of the garment, and FIG. 5 shows how the sea anchor is used in the sea.

FIGS. 6 to 8 show a fourth embodiment of this invention of which FIG. 6 is a front view of the garment with the fasteners on one of the sleeves and one of the leg portions closed, and the fasteners on the other sleeve and the other leg portion open, FIG. 7 is a rear view thereof, and FIG. 8 is a partial side view of the garment with the air chambers filled with air.

DETAILED DESCRIPTION OF THE INVENTION

Figure 1:
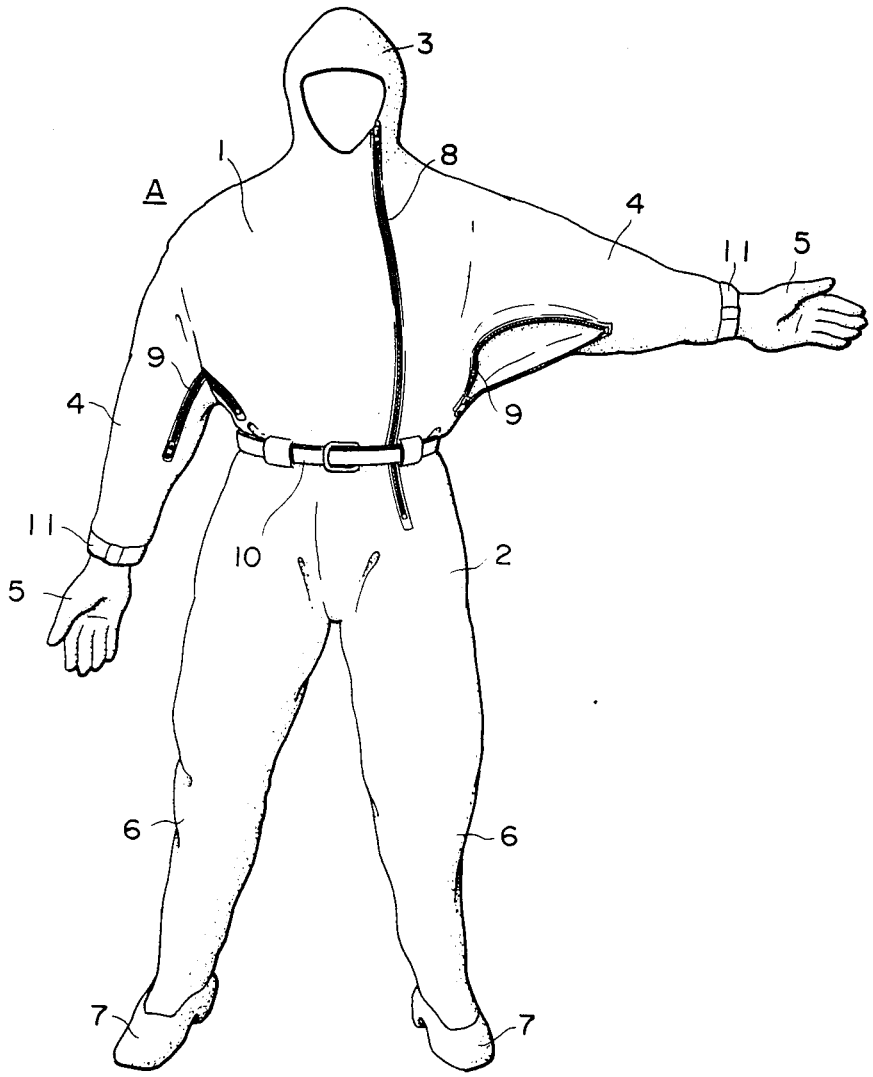
FIG. 1 is a front view of the garment of one embodiment of this invention, shown with the fastener on one of the sleeves closed and the fastener on the other sleeve open.
Figure 2:
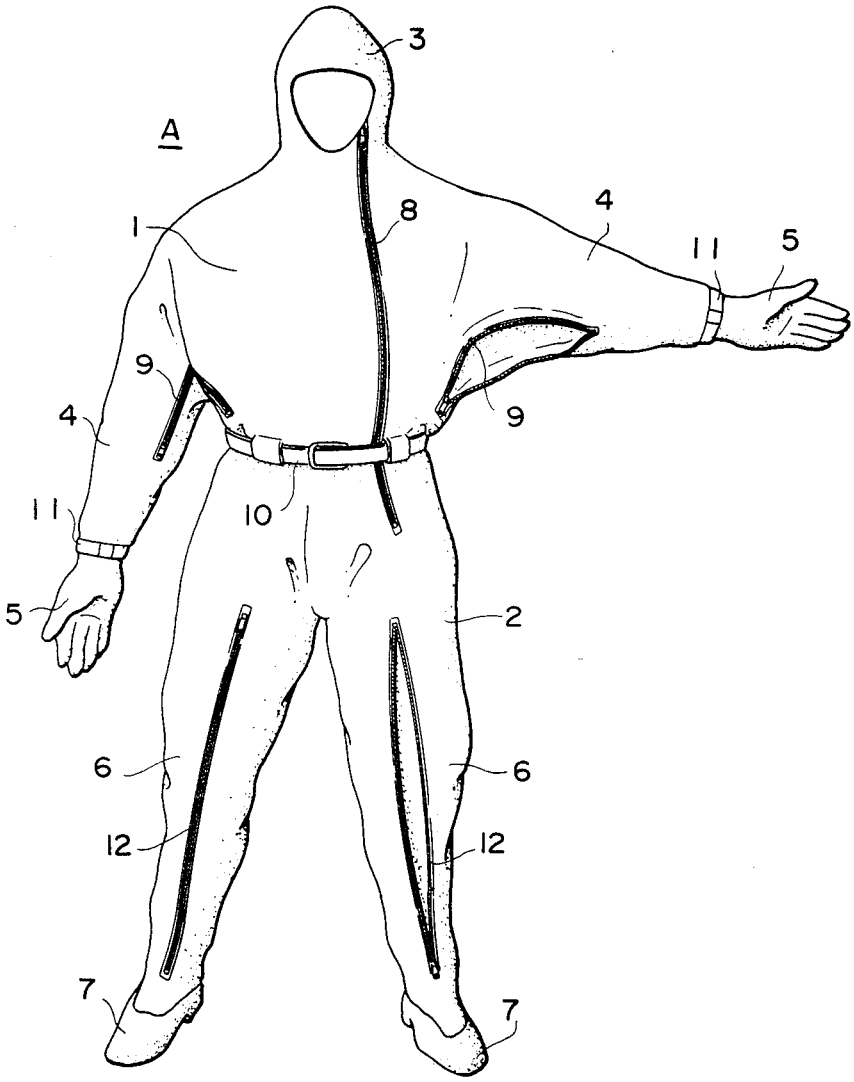
FIG. 2 is a front view of the garment of another embodiment of this invention, shown with the fasteners on one of the sleeves and one of the leg portions closed, and the fasteners on the other sleeve and the other leg portion open.
Figure 3:
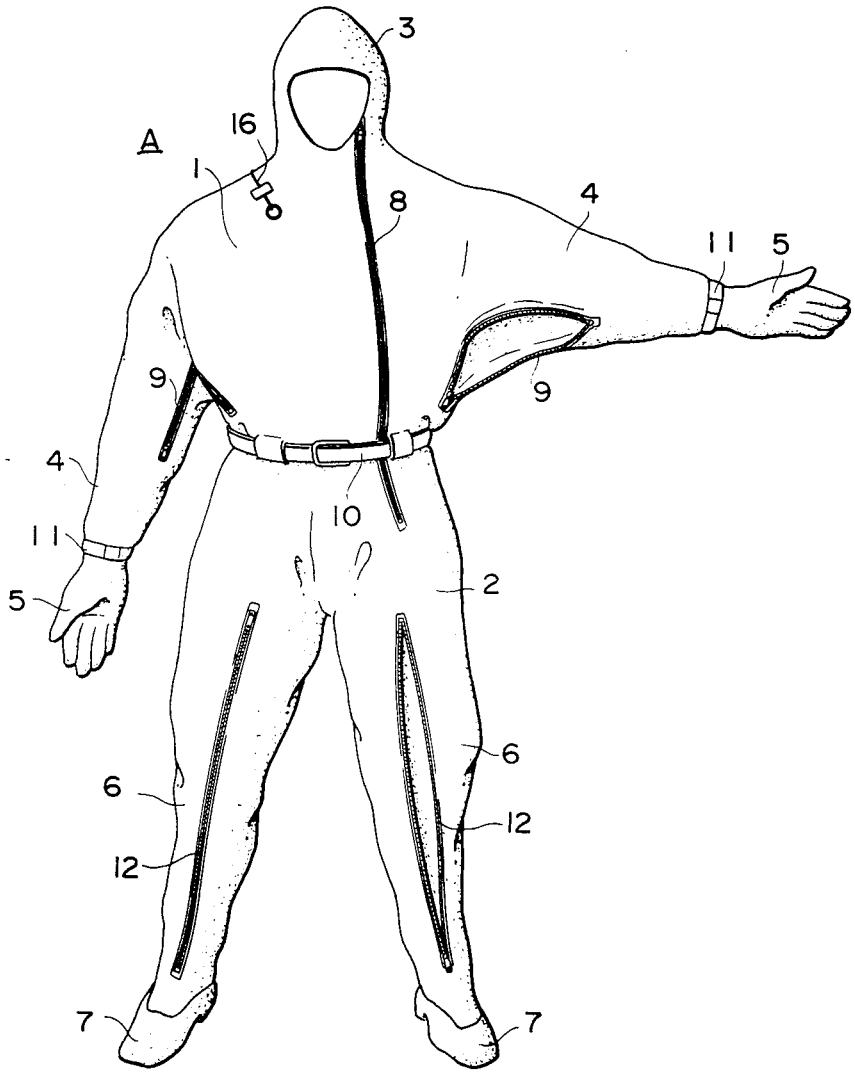
Figure 4:
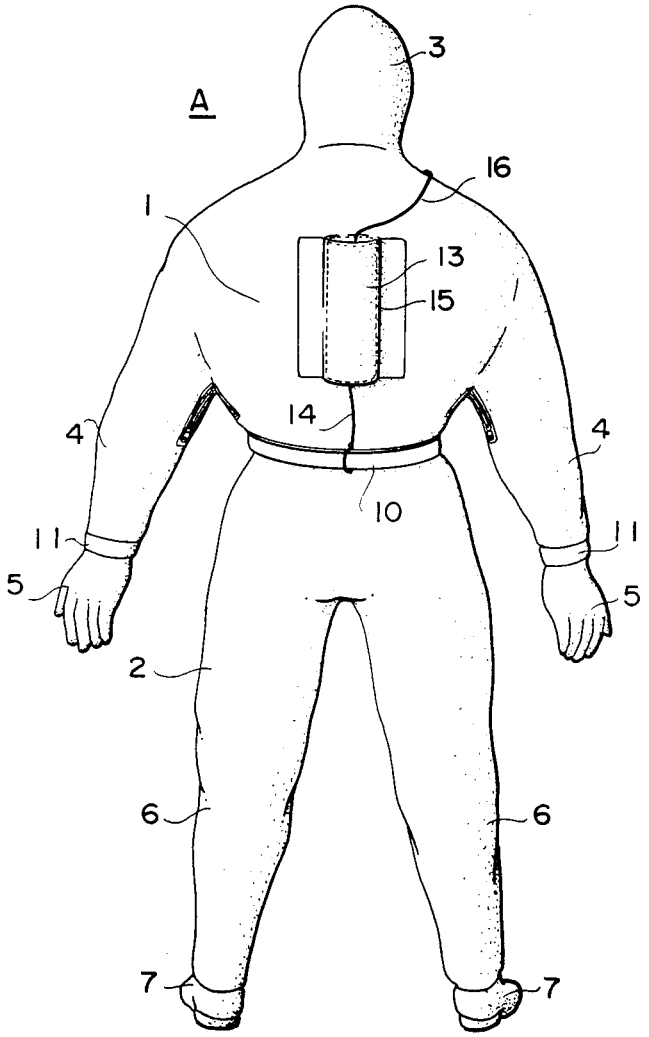
Figure 5:
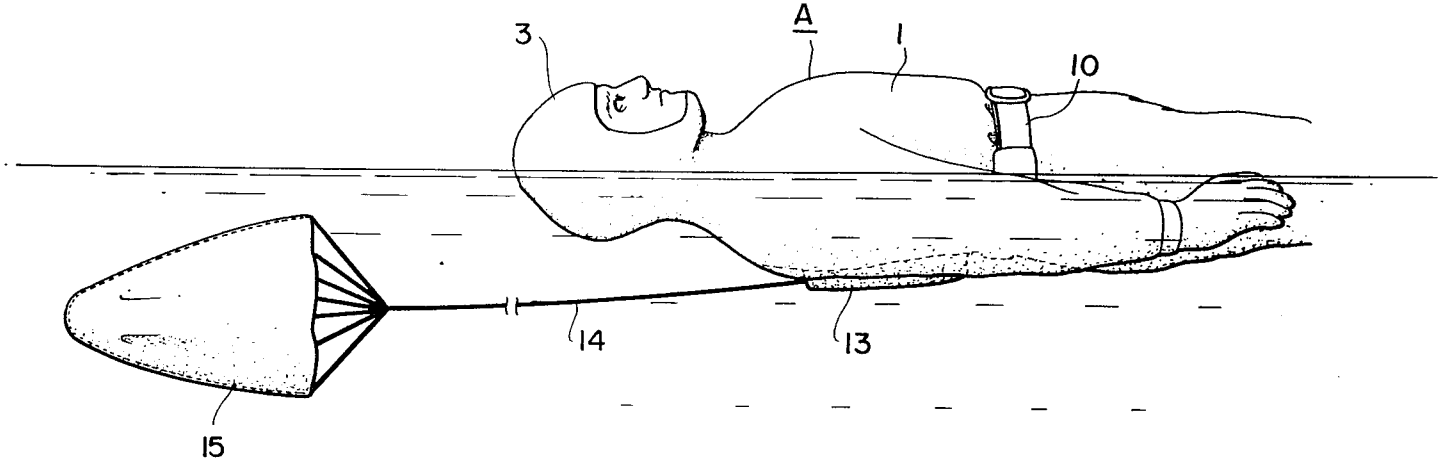
Figure 6:
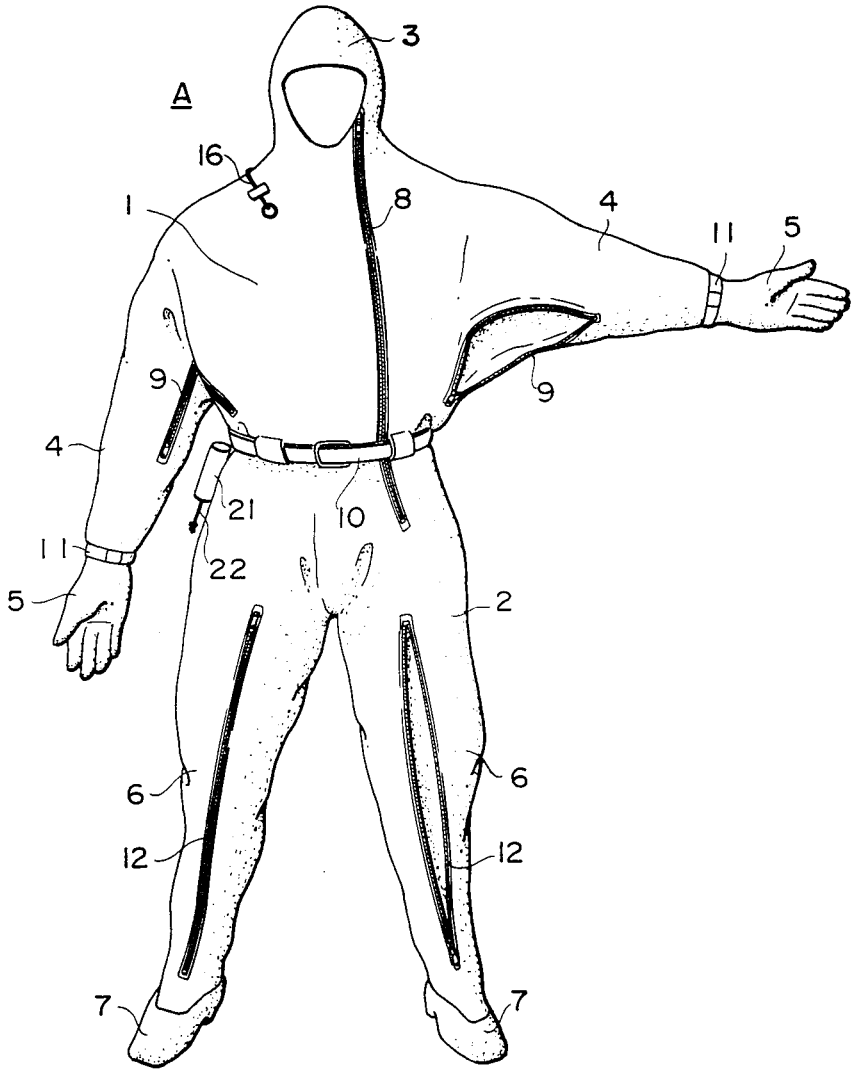
Figure 7:
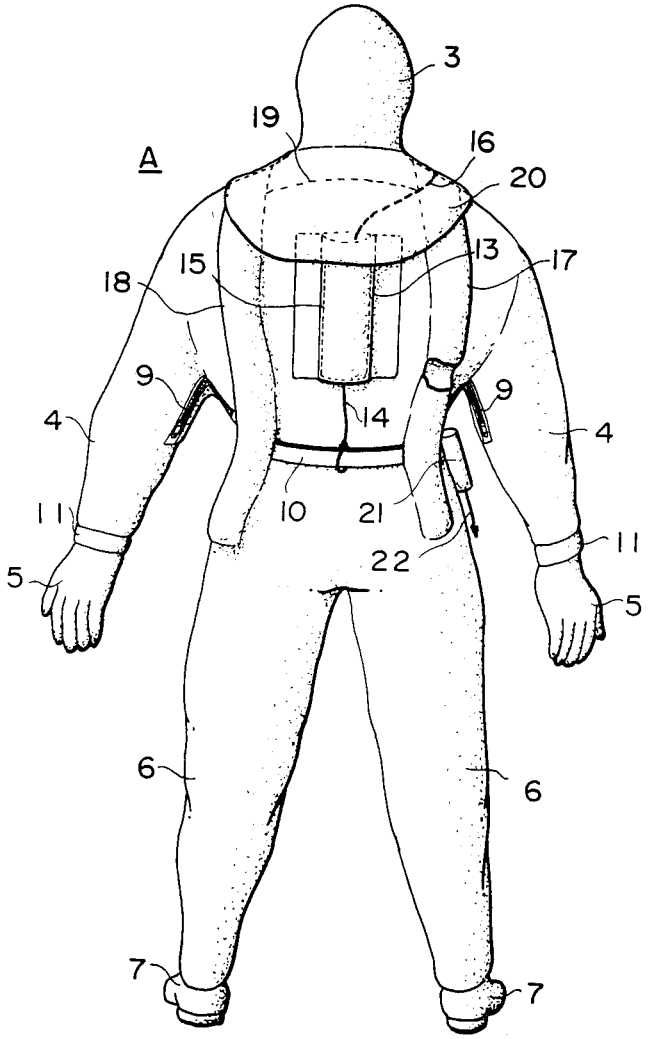
Figure 8:
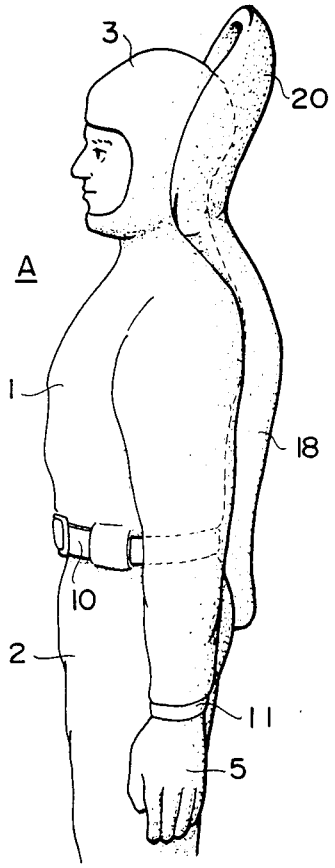
Figure 9:
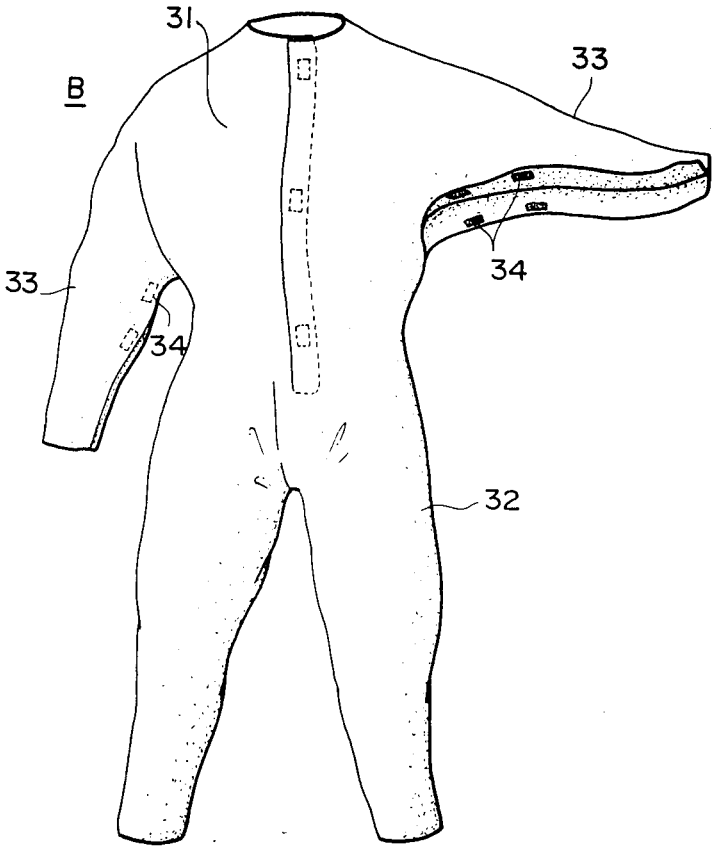
FIG. 9 is a front view of an inner cloth for the cold-proof water-proof garment of this invention.

The garment of this invention consists of upper and lower body portions and a hood which are formed integrally of a waterproof material such as rubber, or of a water-proof fabric of a synthetic resin, synthetic fibers, etc., and which also has integral gloves at the ends of sleeves and integral shoes at the ends of leg portions, both the gloves and the shoes being made of the same material or fabric as the body and hood portions, and is characterized in that:

(1) the sleeves are formed as Dolman sleeves and a fastening means such as a zip fastener is provided on the underside of each sleeves so as to extend a suitable length from the armpit toward the cuff of the sleeve so that the size of the sleeves can be increased or reduced to suit the situation;

(2) a fastening means is also provided so as to extend vertically for a suitable length along each leg portion so that the size of the leg portions can be increased or reduced as desired;

(3) a rope of a suitable length is provided at the rear of the garment, one end of he rope being secured to a suitable part of the garment and the other end thereof being connected to a sea anchor of a suitable configuration which is normally housed in a container on the back of the garment so that it can be taken out when so desired; and (4) the garment is so designed that air can be charged into two side portions and a top portion at the rear of the upper half of the garment.

Thus, the cold-proof water-proof garment of this invention provides its wearer with the following benefits at work or at other times:

(1) The wearer can zip up the fasteners along both sleeves to make the sleeves narrower so as to improve the practicality of the garment, but if he should fall into the sea by accident, he can unzip the fasteners to enable him to pull has hands in from the gloves and place them close to his body to warm them. This can prevent frostbite of his hands.

(2) The wearer can zip up the fasteners along both leg portions of the wear to make the leg portions narrower and drive out the air therein to improve practicality of the garment, but if he should fall into the sea by accident, he can unzip the fasteners to increase the size of the leg portions to allow him to relax his legs and promote the circulation of his blood.

(3) When the wearer is in the sea, he can remove the sea anchor from its housing on the rear of the garment so that its resistance can prevent him drifting away under the action of the wind or tide, so that he can keep afloat with his head always to windward to expedite has rescue.

(4) Intercommunicating air chambers are provided at two side portions and an upper portion on the rear of the upper half of the garment, and a compressed air cylinder or a similar device is provided in communication with the air chambers so that the wearer can operate the cylinder when in the sea to charge air into the air chambers to make these portions of the wearer buoyant so that he can maintain a stable posture while drifting in the sea.

front of the garment by a hand in the other glove and sleeve along the underside of each sleeve from the armpit to a point adjacent to but spaced from the end of the sleeve so that upon entry of the wearer into the water the size of said sleeves can be increased sufficiently to permit withdrawal of the hands from said gloves and said sleeves into the upper body portion of said upper body portion to reduce the likelihood of frostbite, said garment further including a sea anchor;

securing means; and a rope secured at one end to the rear of the garment and to said sea anchor at the other end thereof, said securing means being carried by said upper portion for removably securing said sea anchor to the rear of said upper portion and including means accessible to the wearer from the front of the garment for selectively unsecuring said sea anchor from said upper portion.

2. The garment of claim 1 including fastening means along the length of said leg portions so that the size of said leg portion can be increased upon entry of the wearer into the water to thereby increase the ease of passage of air from one portion of the garment to another and to increase the ease of movement of the wearer while in the water.

3. The garment of claim 1 wherein said upper body portion includes;

interconnected side and top air chambers on the rear thereof; and means for selectively inflating said air chambers.

* * * * *

United States Patent [19]

Meyer

[11] Patent Number: 4,563,158

[45] Date of Patent: Jan. 7, 1986

[54] FUEL IGNITION DEVICE AND METHOD OF ASSEMBLING SAME

[75] Inventor: Helmut P. Meyer, Sidney, N.Y.

[73] Assignee: Allied Corporation, Morristown, N.J.

[21] Appl. No.: 488,949

[22] Filed: Apr. 27, 1983

[51] Int. Cl.[4] ..... H01T 21/02

[52] U.S. Cl. ..... 445/7

[58] Field of Search ..... 445/7; 313/137

[56] References Cited

U.S. PATENT DOCUMENTS

| | | | |
|---|---|---|---|
| 1,835,574 | 12/1931 | Rabezzana | 445/7 |
| 2,136,206 | 11/1938 | Dukelow | 313/137 |
| 2,525,536 | 10/1950 | Faatz et al. | 123/69 |
| 2,898,395 | 8/1959 | Schurecht | 445/7 |
| 2,933,631 | 4/1960 | Logan | 445/7 |
| 3,013,174 | 12/1961 | Logan | 445/7 |
| 3,229,032 | 1/1966 | Willis | 174/52 |
| 3,295,005 | 12/1966 | Poellet et al. | 445/7 |
| 3,581,141 | 5/1971 | Beaubier | 313/130 |
| 3,967,149 | 6/1976 | Eaton et al. | 445/7 |
| 3,995,184 | 11/1976 | Insley | 445/7 |
| 4,097,977 | 7/1978 | Pollner | 445/7 |
| 4,110,667 | 8/1978 | Graf Vom Hagen | 445/7 |
| 4,497,633 | 2/1985 | Meyer | 445/7 |

*Primary Examiner*—Kenneth J. Ramsey
*Assistant Examiner*—Kurt Rowan
*Attorney, Agent, or Firm*—B. L. Lamb; R. M. Trepp

[57] ABSTRACT

A fuel ignition plug (10) includes an outer electrode (12) defined by a conductive shell which surrounds a central electrode (28) and an insulator body (22) between the central electrode (28) and outer electrode (12). Fused glass powder seals (40,42) between the shell and the insulator body (22), and between the insulator body (22) and the central electrode (28), prevent combustion gasses from passing through the interior of the device (10). The device (10) is assembled by holding the electrodes (12,28) and insulator body (22) in fixed, concentric relationship with each other while the seals (40,42) are heated and extruded into sealing position against a shoulder (38,52) of the insulator body (22). The seals (40,42) are extruded into sealing position by applying force to push rings (44,46) which are respectively sleeved over the insulator body (22) and central electrode (28) and bear against the seals (40,42).

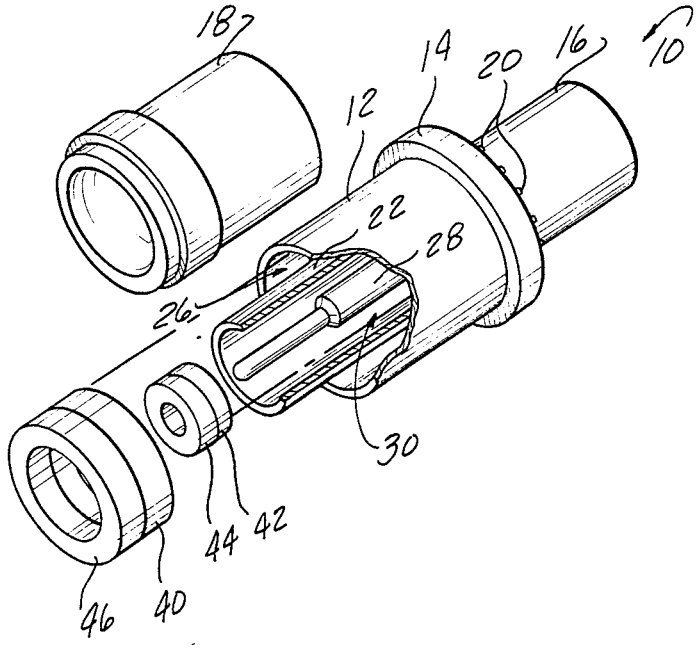

2 Claims, 3 Drawing Figures